United States Patent [19]

Fahmuller et al.

[11] Patent Number: 4,899,528

[45] Date of Patent: Feb. 13, 1990

[54] CONTROL DEVICE TO DRIVE AND STOP AN OPEN-END SPINNING ELEMENT

[75] Inventors: Maximilian Fahmuller, Kelheim; Edmund Schuller; Gottfried Schneider, both of Ingolstadt, all of Fed. Rep. of Germany

[73] Assignee: Schubert & Salzer Maschinenfabrik Aktiengesellschaft, Ingolstadt, Fed. Rep. of Germany

[21] Appl. No.: 290,101

[22] PCT Filed: Apr. 28, 1988

[86] PCT No.: PCT/DE88/00252

§ 371 Date: Oct. 11, 1988

§ 102(e) Date: Oct. 11, 1988

[87] PCT Pub. No.: WO88/09837

PCT Pub. Date: Dec. 15, 1988

[30] Foreign Application Priority Data

Jun. 12, 1987 [DE] Fed. Rep. of Germany ..... 3719676

[51] Int. Cl.[4] ..... D01H 1/26; D01H 1/241; D01H 7/882; D01H 15/02

[52] U.S. Cl. ..... 57/92; 57/88; 57/93; 57/104; 57/263; 57/406

[58] Field of Search ..... 57/88, 89, 92, 93, 104, 57/105, 261, 263, 406, 407, 264

[56] References Cited

U.S. PATENT DOCUMENTS

| | | | |
|---|---|---|---|
| 3,704,579 | 12/1972 | Tooka et al. | 57/93 X |
| 3,791,128 | 2/1974 | Landwehrkamp et al. | 57/93 X |
| 4,059,946 | 11/1977 | Bottcher et al. | 57/93 X |
| 4,112,659 | 9/1978 | Stahlecker et al. | 57/88 X |
| 4,163,359 | 8/1979 | Honjo | 57/93 |
| 4,265,083 | 5/1981 | Braun et al. | 57/88 X |
| 4,276,741 | 7/1981 | Stahlecker et al. | 57/263 |
| 4,638,625 | 1/1987 | Lovas et al. | 57/263 |
| 4,644,742 | 2/1987 | Lovas et al. | 57/263 |
| 4,745,737 | 5/1988 | Feuchter | 57/263 |
| 4,760,688 | 8/1988 | Beitzinger | 57/92 |

FOREIGN PATENT DOCUMENTS 2140836 12/1984 United Kingdom .

*Primary Examiner*—John Petrakes
*Attorney, Agent, or Firm*—Dority & Manning

[57] ABSTRACT

A device for the control of an open-end spinning element, including a pivoted control lever (4) is provided which is capable of assuming three different working positions. In a production position the control lever brings a first drive, running at production speed, into driving contact in the operation of the open-end spinning element. In a braking position the control lever brings a brake to act upon the spinning element. The control lever in a piecing position brings a second drive which runs at a lower speed than the first drive into driving contact with the open-end spinning element. At least the positions determining the production and the piecing position of the control lever are provided with a common control element, capable of being moved back and forth in the direction of movement of the free end of the control lever between at least two switching positions. The control element is provided with a stop element which determines at least the production or the piecing position of the control lever, depending upon the switching position (I, II) of the control element. The stop element is an integral part of the control element. The control element, in addition to movement in the direction of movement of the free end of the control lever, can also be moved transversely to the direction of movement of the free end of the control lever.

30 Claims, 8 Drawing Sheets

P1
70
42
4
60
41
6
83
61
7
74
51
84
80
I
730
8
II
75
40
82
73
5
120
72
71
50
12
33
330
210
21
301
10
11
1
201
300
23
30
32
2
203
302
31
20
200
202
22

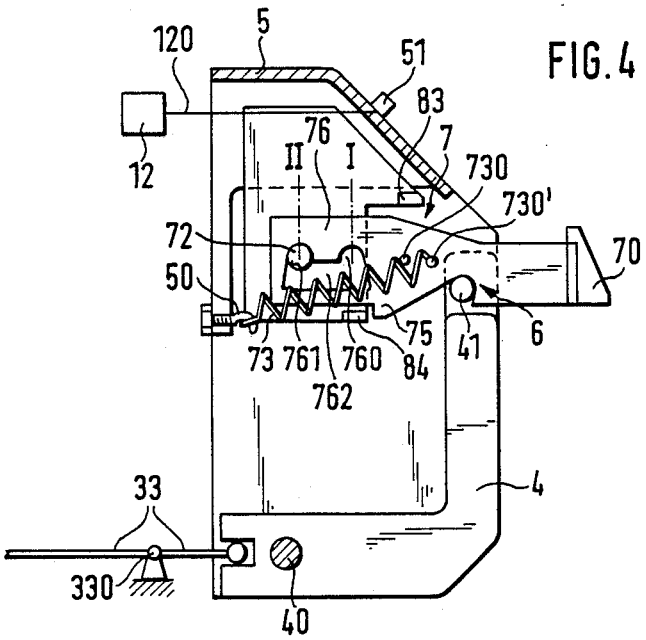
FIG. 4
FIG. 5
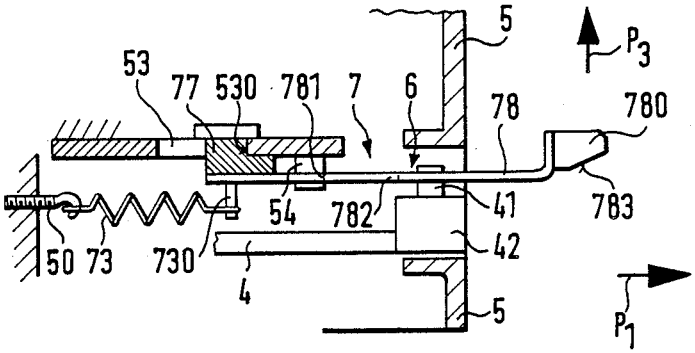

CONTROL DEVICE TO DRIVE AND STOP AN OPEN-END SPINNING ELEMENT

BACKGROUND OF THE INVENTION

The instant invention relates to a control device for driving and stopping an open-end spinning element, with a pivoted control lever capable of assuming a production position, a piecing position and a braking position, where it connects a first drive running at production speed when it is in its production position, a second drive running at a slower speed than the first drive when it is in its piecing position, and brings a brake to bear upon the open-end spinning element when it is in its braking position. The control device is provided with stops to hold the control lever in one of the three positions.

To be able to stop an open-end spinning element as desired or to drive it at a predetermined first or second speed, a pivoted control lever capable of assuming three different working positions is known (See WO No. 86/03792). In its production position, the control lever brings a first drive, running at production speed, into driving contact with the spinning element, in its piecing position it brings a drive running at a slower speed than the first drive into driving contact, and in its braking position it brings a brake into contact. The control lever is provided with stops, each of which holds the control lever in one of the three positions. At least the stops holding the control lever in production position and in piecing position are capable of being controlled. Control is effected by means of a solenoid which is controlled by a switching device which also controls the fiber feeding to the spinning device. In order to achieve the necessary time delay between the reinsertion of the fiber feed and the control of the stop, the switching device is followed by a control device. Such a device is expensive, especially if the actuating times for the resumption of fiber feeding and the activation of the stop vary because of different materials being used. Furthermore, such adaptations can only be carried out by trained personnel.

SUMMARY OF THE INVENTION

It is, therefore, the object of the instant invention to provide a device of the above-mentioned type which makes it possible for even untrained personnel to easily control the control lever, and the spinning element, independently of other elements.

This object is achieved through a device of the type mentioned above in that a common control element is provided with stops determining the production position and the piecing position of the control level. The control element is capable of being moved back and forth between at least two switching positions in the direction of movement of the free end of the control lever. The stops for the control lever are activated by means of the common control element, where the mobility of the control element in direction of the free end of the control lever makes it possible bring, alternately into or out, of contact the stop for the production position of the control lever and the stop for the piecing position of the control lever. Control of the control lever is entirely independent of the control of other elements of the open-end spinning device, such as for example, switching on fiber feeding, switching on the yarn monitor, etc., so that the desired activation of the control lever can be obtained without complicated resetting, even manually.

It is not necessary to provide separate stops for the production position and for the piecing position of the control lever. According to a preferred embodiment of the invention, a stop element which, depending upon the switching position of the control element, constitutes either the stop determining the production position or the stop to determine the piecing position of the control lever, is installed on the control element.

To provide a strong and simple embodiment of the invention, the stop element is an integral part of the control element. The control element has the role of determining, by means of its stop element, the applicable work position of the control lever. For that reason, the control element, in addition to being capable of movement in the direction of movement of the free end of the control lever, to be also capable of moving transversely to the direction of movement of the control lever in order to release the control lever and to determine the work positions of the control lever. This is achieved through a control element sliding in a slot, for example. The control element is, however, mounted so as to be capable of pivoting for the movement which is perpendicular to the direction of movement of the free end of the control lever.

In principle, the control element with the stop can also be moved parallel to the pivoting axle of the control lever, in order to release the control lever, but it is especially advantageous for the control element with the stop element to be capable of transverse movement in relation to the pivoting axle of the control lever.

In the preferred embodiment of the invention, an essentially U-shaped slotted guide is provided, the ends of the guide extend transversely to the direction of movement of the free end of the control lever and determine two switching positions of the control element, together with a stop bolt reaching into the slotted guide, so that said control element is securely located in its two switching positions. In another embodiment of the device according to the invention, the U-shaped slotted guide is provided on the control element.

In an especially simple embodiment of the control, the control element is pivotally mounted on the control lever. The control element is, in this case, made in the form of a two-arm lever, the first arm of which is provided with the slotted guide while the second arm extends essentially parallel to the control lever and is subjected to the force of a spring bearing upon the control lever, in such a manner that the stop bolt on the first arm remains in one of the ends of the slotted guide. In order to be able to move the control lever from one working position into the next, it is merely necessary to pivot the two-arm lever in relation to the control lever so that the stop bolt can go in the slotted guide from one end into the other end.

Easy activation is achieved if the control lever is provided with an extension, reaching beyond the mounting location of the control element, with the second arm of the control element extending essentially parallel to the extension.

If it is desired for the control element to determine not only the production position and the piecing position of the control lever, but also its braking position, the slot can be made in form of an E instead of a U, where the three free ends of this E-shaped slotted guide extend transversely to the direction of movement of the free end of the control lever.

In the preferred embodiment of the object of the invention, the control element is provided with two pivoting axes which can be brought into action selectively, where one pivoting axis is provided for the stop element, and the other pivoting axis is constituted by a stop which determines at least one switching position of the control element. In order to release the control lever or to cause it to catch behind the stop element, the control element is pivoted around the pivoting axis which is constituted by one of the stops constituting the switching positions of the control element. Even though the control lever is released or retained, the control element remains in its former switching position.

If, however, the control element is to assume its other switching position, the control element is pivoted around the pivoting axis provided for the stop element. In this way the control element is released from the stop determining its switching position and can be brought into its other switching position.

When the control element is mounted pivotally, it may occur that the control element is pivoted to such an extent, due to gravity, that the control lever cannot be brought back into its production or piecing position. To prevent this, the control element is provided with a stop, limiting its movement in the direction of the control lever.

In the above-described embodiment, the control element must execute movements in three different directions. To make it possible that only switching movements in one single direction be required, a further embodiment of the object of the invention provides for the stop element, which is integrated into the control element, to be assigned a stop element located on the free end of the control lever and capable of transverse movement in relation to the direction of movement of the free end of the control lever, the stop element being, in turn, provided with a drive element that is capable of movement relative to the control element. The stop element, which is capable of movement relative to the control lever, and is mounted within the latter, can be moved by the drive element, which is capable of movement in relation to the control element, in such manner that it is removed from the zone of influence on the stop element and integrated into the stop element, enabling the control lever to reach its other working position. It is advantageous, in this case, for the drive element to be mounted on the control element in such manner that it can be moved in relation to the latter. In another embodiment the drive element, is capable of movement in the direction of movement of the control element, and is provided with a climbing ramp to disengage the stop element, which is movably installed on the free end of the control lever, from the stop element which is integrated into the control element.

It is not necessary for the stop element to be integrated into the control element. In another embodiment, the stop element interacting with the control lever is movably mounted in relation to the control element, this stop element being advantageously part of a pivoting lever.

In another embodiment of the invention, in order to secure the control element in at least one of its two switching positions, the control element is provided with a stop capable of transverse movement in relation to the direction of movement of said control element.

The movements of the control lever can be achieved by providing each of the control lever, the control element, the stop which is movable in relation to the control element, as well as the drive element for the stop element movably installed at the free end of the control lever, the drive element being movable in relation to the control element, or the stop element which is movable in relation to the control element, with a drive surface which can be adjusted by movable adjusting means. Such a structure is suitable, not only for manual control of the control lever, but can be used to equal advantage for the automatic control of the control lever and of the spinning element.

To ensure that no malfunctions occur in the movement of the control element from one of its switching positions into its other switching position, an embodiment of the invention is provided with a guide assigned to the control element which limits transverse movements in relation to the free end of the control element during the movement of the control element in the direction of movement of the free end of the control element.

As a rule, the control lever is subjected to the force of a spring in the direction of movement corresponding to the movement of the control lever going into braking position. To avoid having to exert excessive force in moving the control lever from the production position into the piecing position, the control element is subjected to the force of a spring counter to the direction in which the control lever is being pressed. This spring can be adjustable, e.g. by providing the spring with a continuous-adjustment device.

To avoid having to provide for the stop element blockage of the control lever in two directions, the spring for the control lever is made stronger than the spring for the control element. In this way the control lever always receives a force component counter to the direction in which the control element is being pushed, even when it is additionally subjected to a force by the stop element and the control element.

In principle, the control lever can be assigned in any desired manner to a spinning station. However, in order to achieve not only a functionally advantageous solution but, beyond this, in order to obtain an aesthetic configuration which also decreases the risk of injury, the control element is preferably located in the cover of the spinning station.

Today, most open-end spinning devices can be serviced by an automatic piecing device. To avoid having to produce two models for the open-end spinning machine, depending on whether the machine is intended for manual or automatic servicing later on, the control lever and the control element of the invention can also be controlled by a travelling piecing device. In this way it is possible to provide a device of the type mentioned above for manual operation at first, and to modify the spinning machine later with a piecing device. Even after such a modification has been carried out, the control lever can also be controlled manually as before.

In a simple embodiment of the invention, the switching position of the control element which determines the piecing position of the control lever can be determined by the stroke path of a control means provided on the travelling piecing device in case that automatic control of the control lever is provided. An additional stop for the piecing position can then be omitted.

It is not necessary to install on the control element a stop element capable of movement in the direction of the movement of the free end of the control lever. In a further embodiment of the invention, the stops in the direction of the control lever are subjected to an elastic force and bear with their ends (away from the control lever) upon the climbing ramps of the control element, of which the climbing ramp assigned to the stop determining the production position of the control lever enters into contact after covering a longer switching path than the climbing ramp assigned to the stop which determines the piecing position of the control lever. In this manner, and depending upon the switching path of the control element, only the stop which determines the production position of the control lever remains in effect, or both stops, the one for production position as well as the one for piecing position of the control lever remain in effect, or else both stops are brought out of contact. Secure functioning is thus ensured.

Although the object of the invention can be attained in may different ways, all embodiments have the common feature that control of the control lever, and of the open-end spinning rotor, can be effected easily and independently of other elements. Such a device is particularly well suited for manual activation, but also in combination with an automatic piecing device. The device can be produced inexpensively and is, furthermore, space-saving, so that it can easily find room with any spinning device.

BRIEF DESCRIPTION OF THE DRAWINGS

Different embodiments of the invention are explained in greater detail below through the drawings, in which:

FIG. 4 is a side view of a second embodiment of the device according to the invention similar to the production position of the control lever shown in FIG. 1;

FIG. 5 is a top view of a further embodiment of the invention, in the production position;

DETAILED DESCRIPTION OF THE DRAWINGS

Figure 1:
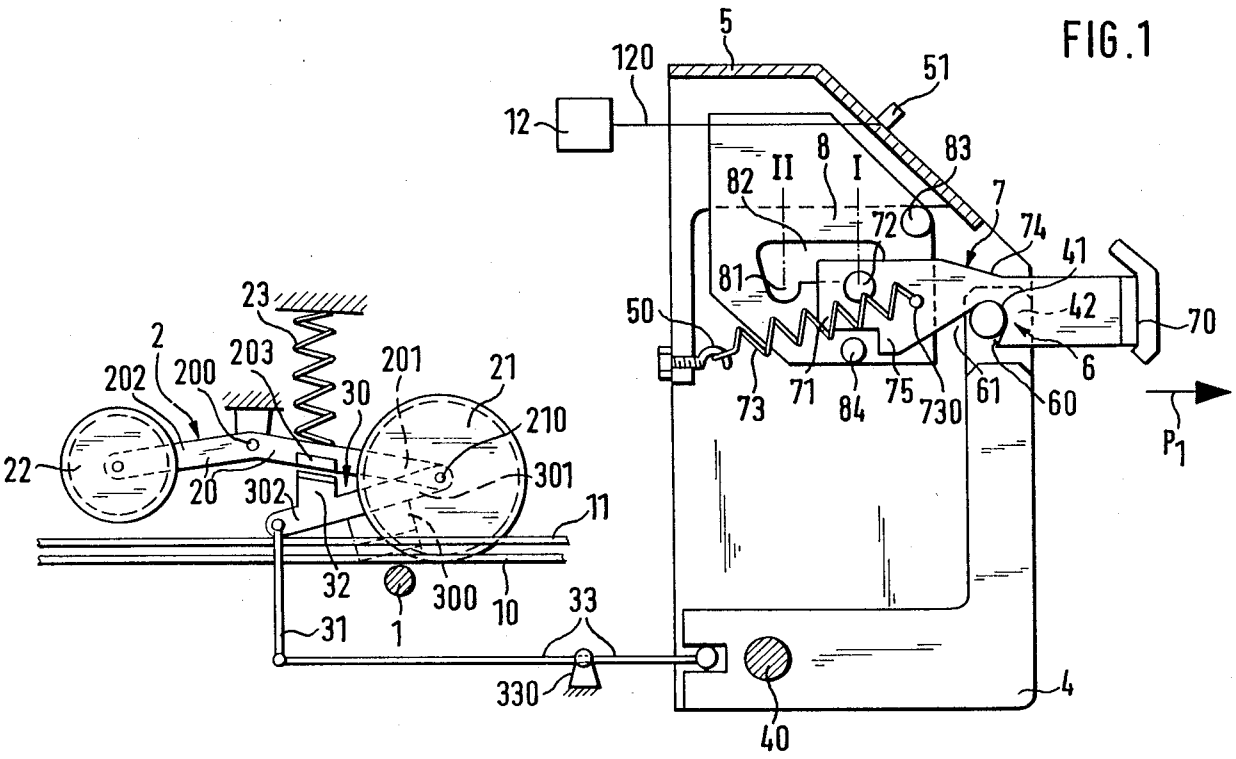
FIGS. 1 to 3 shows a first embodiment of a control device designed according to the invention, in its production, braking and piecing positions, in schematic side-view.
Figure 2:
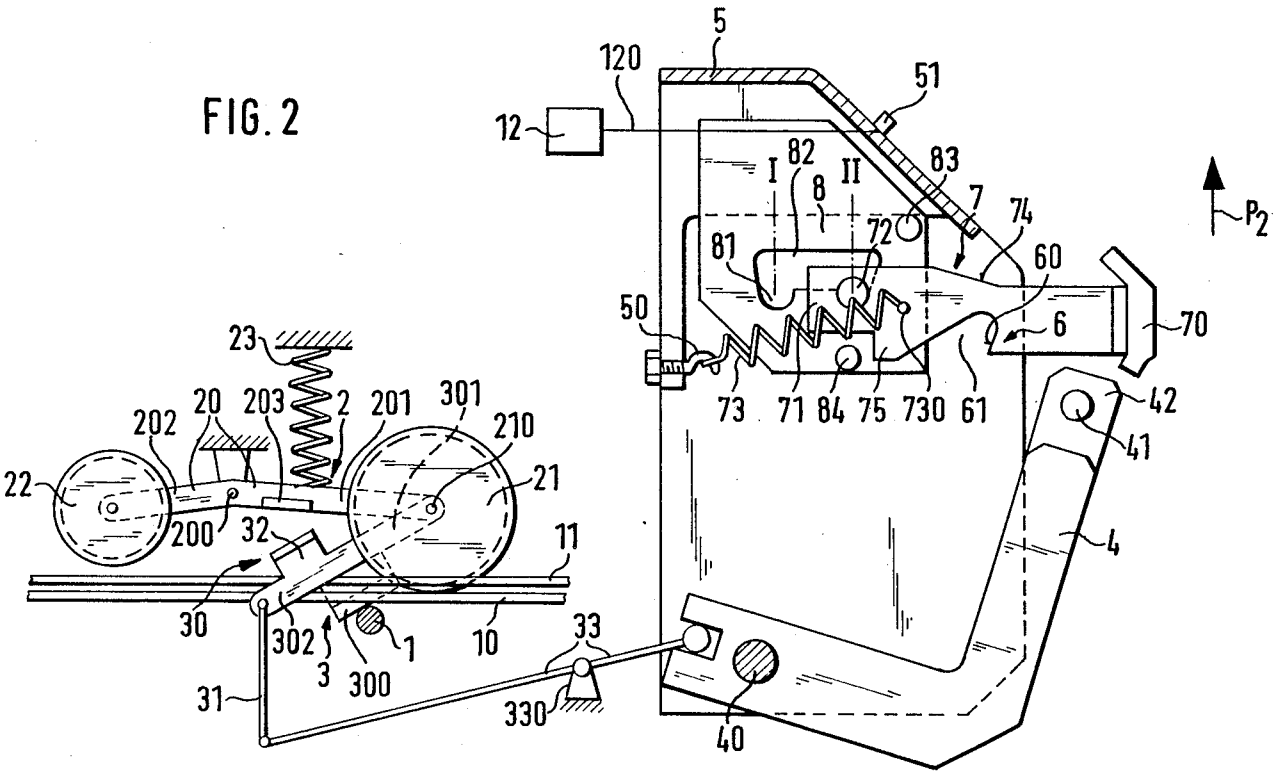
Figure 3:
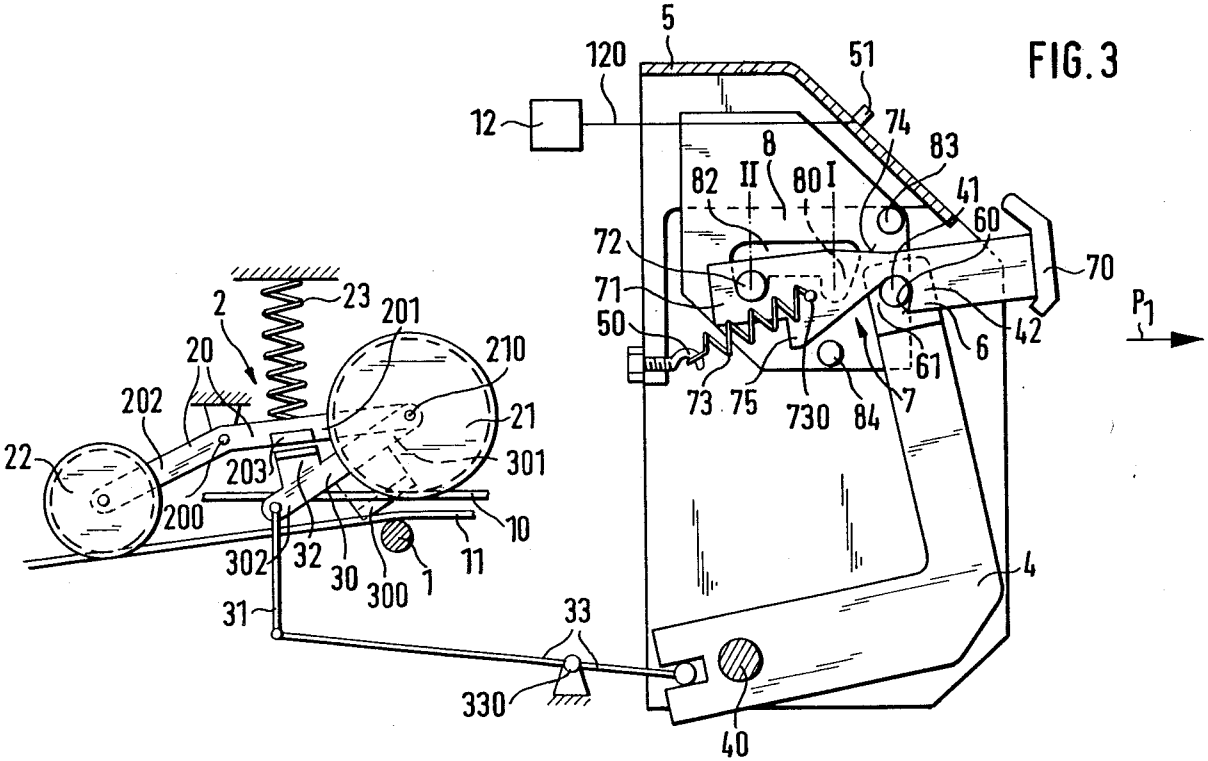

The invention shall first be explained through the example of the embodiment shown in FIGS. 1 to 3. These figures show a spinning station of an open-end spinning machine with a plurality of spinning stations of the same type arranged next to each other, each with a spinning element. In principle, this spinning element, of which only a shaft 1 can be seen, can be of any design, e.g. in form of a spinning rotor. Shaft 1 of the spinning element is mounted in a conventional manner, which is not shown, and is driven selectively by means of a main drive belt 10 or by means of an auxiliary belt drive 11. The two drive belts 10 and 11 are driven in the known manner at different speeds, whereby the speed of the main drive belt 10 corresponds to the production speed of the machine and also to the production speed of rotation of the spinning element. The auxiliary drive belt 11 is driven at a lower speed than the main drive belt 10 so that a spinning element driven by the auxiliary belt drive 11 rotates at a slower speed than a spinning element driven by the main drive belt 10.

To be able to drive the spinning element selectively at a high or at a low rotational speed or to be able to stop it, if necessary, a change-over device 2 is provided for the two drive belts 10 and 11. The change-over device 2 is equipped with a two-arm change-over lever 20 mounted pivotally on an axle 200 in the embodiment shown. The change-over lever 20 is provided with a main pressure roller 21 on one arm 201 which can be brought to bear against the main drive belt 10, while the other arm 202 of the change-over lever 20 is provided with an auxiliary pressure roller 22 capable of being brought to bear against the auxiliary drive belt 11. Supporting disks (not shown) which lift the main drive belt 10 or the auxiliary drive belt 11 from contact with shaft 1 of the spinning element, upon release by the main pressure roller 21 or the auxiliary pressure roller 22, are installed in the usual manner between the individual spinning stations. In this manner either the main drive belt 10 alone, or the auxiliary drive belt 11 alone bears against shaft 1 of that spinning element against which it is brought to bear by the corresponding pressure roller 21 or 22. Arm 201, with the main pressure roller 21, is provided with a pressure spring 23 which normally holds the main drive belt 10 pressed against shaft 1 of the spinning element upon release of the change-over lever 20 with the main pressure roller 21.

As shown in FIG. 2, a brake 3 for shaft 1 is connected to the change-over lever 20. For this purpose a brake lever 30 at the free end of which a drawbar 31 engages is pivotally mounted on axle 210 of the main pressure roller 21. The brake lever 30 is at an angle to arm 201 of the change-over lever 20. Its free end is closer to the plane defined by the main drive belt 10 than arm 201 of lever 20. On its side towards the brake lever 30, arm 201 is provided with a stop 203 against which a catch 32 provided near the free end of the brake lever 30 can be brought to bear.

The brake lever 30 is equipped with a brake lining 300 near axle 210 which can be brought to bear against the shaft 1 of the spinning element, said shaft 1 being also located in direct proximity of the main pressure roller 21. The position of the brake lever 30 with its brake lining 300, divides the brake lever 30 into a first lever arm 301 which is towards the main pressure roller 21, and a second lever arm 302 which is turned towards the free end to which the drawbar 31 is connected. The drawbar 31 is connected to a two-arm lever 33, pivoting around an axis 330 and connected to a control lever 4 for the change-over device 2, and for the brake 3.

For the sake of clarity, control lever 4 is shown turned by 90° in relation to the change-over device 2 in cover 5, the change-over device 2 being, in turn, drawn on a reduced scale above the control lever 4 and the control element 7, in order to show the functional relationships.

The control lever 4 is installed in a slit of a cover 5 of the spinning station and can be moved relatively thereto. According to FIG. 1, the control lever 4 is in alignment with the outer surface of cover 5.

This position is designated as production position I since, in this position of control lever 4, the main pressure roller 21 holds the main drive belt 10 against shaft 1 of the spinning element (not shown) so that the spinning element is driven at high speed, i.e. at the rotational speed for production.

As FIG. 2 shows, the control lever 4 can also assume another position, i.e. the braking position, in which brake 3 is brought into contact with shaft 1 of the spinning element (not shown). According to FIG. 3, the control lever can also assume a third position, the piecing position II, in which the auxiliary pressure roller 22 brings the auxiliary drive belt 11 to bear against shaft 1. The spinning element is then driven at a slower rotational speed than production speed, as is, in general, desirable during the piecing process.

The manner in which the control lever reaches its different positions and in which it is held there is described in greater detail below.

The control lever 4 is mounted pivotally on a pivot axle 40 and is subjected by change-over lever 20, brake lever 30, drawbar 31 and lever 33, in direction of arrow $P_1$, to the force of the compression spring 23 acting upon the change-over device 2. For this reason, control lever 4 is provided with a stop 6 which prevents said control lever 4 from carrying out a pivoting movement in the direction of arrow $P_1$. In the embodiment shown in FIGS. 1 to 3, stop 6 is constituted by a stop element or slot 60 which is an integral part of a control element 7. Control element 7 is mounted in such manner that it can be moved back and forth between, at least two, control positions I and II in the direction of movement of the free end 42, i.e. of the end of lever 4 away from lever 33. The stop element 60 interacts with control lever 4 in control position I as well as in control position II and constitutes the first stop in control position I of the control element, determining the production position of the control lever 4, while constituting the second stop in control position II of the control element 7, determining the piecing position of the control lever 4.

According to FIG. 1, stop element 60 is constituted by a side wall of an essentially slit-shaped recess 61 in the control element 7. The stop element 60 interacts with a counter-stop 41, which is located on the lateral surface of the free end of control lever 4, towards control element 7. This counter-stop 41 is essentially in form of a cylinder and extends laterally into recess 61 in control element 7, limited by the stop element 60.

Control element 7 extends with one service end 70 outside of cover 5. At its end 71 away from the service end 70, control element 7 is equipped with a stop bolt 72 which enters an essentially U-shaped slotted guide 8 which is attached to cover 5 (in a manner which is not shown here). The two ends 80 and 81 of the slotted guide 8 extend transversely to the direction of the control element movement, designated by arrow $P_1$, and of the free end 42 of control lever 4 while the connection segment 82 extends essentially into the direction of the movement, designated by arrow $P_1$, of the free end 42 of control lever 4, and thus also in the direction of movement of the control element 7.

Control element 7 is subjected to the force of a spring 73, opposite to the direction, designated by $P_1$, in which the control lever 4 is subjected to the force of pressure spring 23. For this purpose a spring bolt 730 is provided on the control element 7 to which spring 73 is anchored. The other end of the spring is anchored to a spring hook 50 or similar device mounted on cover 5.

FIG. 1 shows the device in spinning or production position, in which the main drive belt 10 bears against shaft 1 of the spinning element (not shown). If the latter is to be stopped, the brake lever 30 with its brake lining 300 is brought by means of the drawbar 31 to bear against shaft 1. As the drawbar 31 continues to move, the brake lever 30 acts as a two-arm lever bearing upon shaft 1 of the spinning element and lifting the main pressure roller 21 with its lever arm 301 to such an extent that the main drive belt 10 is lifted from shaft 1 by the supporting disks (not shown). The change-over lever 20 is, at the same time pivoted across catch 32 and stop 203 to such an extent that, while the main pressure roller 21 no longer presses the main drive belt 10 against shaft 1, the auxiliary pressure roller 22 on the other hand still does not bring the auxiliary drive belt 11 to bear against shaft 1 of the spinning element.

As FIG. 1 shows, the drawbar 31 is controlled by means of the control lever 4 which is pivoted from the position shown in FIG. 1 into the position shown in FIG. 2 (in the direction of arrow $P_1$). For this purpose, the control element 7 is pivoted around a stop bolt 72 which constitutes a pivoting axle, by lifting the service end 70 (see arrow $P_2$). In this way stop 6 frees the counter-stop 41. The effect of the pressure spring 23 through arm 201 and stop 203 of the changeover lever 20, through the catch 32 and the arm 302 of brake lever 30, through drawbar 31 and lever 33 upon the control lever 4, causes the latter to be moved in the direction of arrow $P_1$ after release by the control element 7. This movement of the control lever 4 is limited by a stop (not shown), the stop being constituted for example by part of the cover 5.

In a known manner, not shown here, a switch can be provided on the cover 5 to activate a cleaning device for the spinning element, installed in the cover, whereby the switch is activated by relative movement of control lever 4 in relation to cover 5. This causes cleaning of the spinning element to be carried out simultaneously with the braking of the spinning element. If, however the control lever 4 is brought into braking position without activation of the control element 7, by pivoting cover 5 into braking position, brake 3 is activated, but not the cleaning device.

If piecing is to be carried out again, the control lever 4 is first brought back from the position shown in FIG. 2 into the position shown in FIG. 1 in which the control lever 4 is held by counter-stop 41 catching in the recess 61 of stop 6, since the control element 7 is always pressed downward against control lever 4 due to the force of the spring 73.

The movement of the control lever 4 from the position shown in FIG. 2 back into the position shown in FIG. 1 causes brake lever 30 to be lifted from shaft 1 of the spinning element by lever 33 and drawbar 31 and causes the change-over lever 20 to be released again by brake lever 30, so that the main pressure roller 21 again presses the main drive belt 10 against shaft 1 of the spinning element. The spinning element is again accelerated. At a given moment, if possible before production speed has been reached, the control lever 4 is pivoted from the position shown in FIG. 2 into the position shown in FIG. 3 in order to drive the spinning element at a reduced but constant speed. In this manner the acceleration of the spinning element is accomplished through the main drive belt 10 while the auxiliary drive belt 11 drives the spinning element at a constant rotational speed following a relatively minor speed adaptation.

In order to pivot the control lever 4 from the production position into the piecing position, service end 70 of control element 7 is pushed in the opposite direction to arrow $P_2$, so that the stop bolt 72 leaves the end 80 of the slotted guide 8 and comes into its connection segment 82. By exerting pressure upon service end 70 of control element 7 in a direction counter to arrow $P_1$, stop bolt 72 of control element 7 is moved into the area of end 81 of the slotted guide 8. No further pressure is then exerted upon the service end 70 of the control element 7 counter to the direction of arrow $P_2$, so that the spring 73 pulls the end 71 of the control element 7, together with stop bolt 72 into the end slot 81 of the slotted guide 8.

During the movement of control element 7 in a direction counter to arrow $P_1$, the control element 7 has slaved the control lever 4, caught with the counter-stop 41 in recess 61, so that control lever 4 pivots the brake lever 30 through lever 33 and also removes arm 201, with main drive roller 21, from the main drive belt 10 through catch 32 and stop 203. The main drive belt 10 is released and lifts off from the shaft 1 of the spinning element under the effect of the supporting disks (not shown). At the same time, the auxiliary pressure roller 22 now brings the auxiliary drive belt 11 to bear against shaft 1 of the spinning element, so that the spinning element is now imparted a rotational speed which is determined by the auxiliary drive belt 11. In this position of the control lever 4, the piecing process, which can now proceed in a known manner, is carried out at reduced speed of the spinning element. For example, a control knob 51 is provided on the cover 5 for the control of fiber feeding, the knob being connected by a switching connection 120 to a control device 12 for a fiber supply device (not shown), so that the feeding of the fibers to the spinning element is again switched on.

After completion of the piecing operation, the service end 70 of the control element is pressed in a direction counter to that of arrow $P_2$, so that the control element 7 bears against the counter-stop 41 and can be pivoted around the pivoting axle constituted by this counter-stop 41. The stop bolt 72 leaves end 81 of the slotted guide 8, comes into its connection segment 82 and is brought back into the basic position shown in FIG. 1, in which the spring 73 pulls the stop bolt back into the end 80 of the slotted guide 8, under the effect of the pressure spring 23 through control lever 4 and stop 6 (stop element 60). This pivoting motion of the control lever enables the auxiliary pressure roller 22 to cause the auxiliary drive belt 11 to be lifted from shaft 1 of the spinning element while the main pressure roller 21 simultaneously again brings main drive belt 10 to bear against shaft 1. In this position, the brake lever 30 remains lifted away from shaft 1, as before.

The U-shaped slotted guide 8, with its two ends 80 and 81 extending transverse to the direction of movement of the free end 42 of the control lever 4 determine, together with the stop guide 72 engaging the slotted guide 8, the two switching positions I (for the spinning position of the control lever 4) and II (for the piecing position of control lever 4).

As the control element 7 moves from switching position I into switching position II or back, control element 7 is guided by means of stop bolt 72 in the slotted guide 8. In order to prevent control element 7, with its stop 6, from simultaneously releasing the counter-stop 41 of control lever 4, the design according to FIGS. 1 to 4 provides for a guide for the control element 7, limiting transverse movements with respect to the movement of the control element in direction of arrow $P_1$ or in the opposite direction. For this purpose, a guide bolt 83, against which the control element 7 can be brought to bear by its edge 74 as it moves in the direction of arrow $P_1$ or in opposite direction, is provided on the slotted guide 8. The relative positions of guide bolt 83 and edge 74 of the control element 7 are selected so that when the stop bolt 72 is within the connecting segment 82 of the slotted guide 8, it is impossible for the stop 6 to release the counter-stop 41 of the control lever 4.

When the control lever 4 is in the position shown in FIG. 2, the control element 7 can no longer bear against the counter-stop 41 of the control lever 4. In order to prevent the control element 7 from assuming an uncontrolled position, a stop bolt 84 is provided on the side toward the control lever 4 on the slotted guide 8, according to the embodiment shown in FIGS. 1 to 3. The control element 7 is, in turn, provided with a stop projection 75 in the longitudinal zone between the stop bolt 72 and the stop 6, in its side toward the control lever 4, designed so that it limits pivoting of the control element 7 in the direction of control element 4 when control element 7 assumes the switching position I and when the stop bolt 72 is in the end 80 of the slotted guide 8, yet without hindering the movement of the control element 7 from switching position I into switching position II and the penetration of stop bolt 72 into end 81 of the slotted guide 8.

In the embodiment shown thus far, the control element 7 is subjected to the force of a spring 73 in the opposite direction of the pressure exerted on control lever 4 (see arrow $P_1$). This has the advantage that spring 73 reduces the force which must be produced to obtain a movement of the control element 7 from switching position I into switching position II. As shown in FIG. 4, the spring 73 can be made so as to be adjustable. For this purpose the spring bolt 730 on control element 7 can be brought into different positions (see position 730'), several perforations being sufficient for adjustability in steps. If continuous adjustment is desired, this can be obtained by means of an appropriate longitudinal slit in the control element 7, or by providing retention of the spring bolt 50 by means of a threaded bolt (not shown) in the cover 5, whereby its axial position can be changed by rotation.

Since it is, as a rule, preferred for a switching movement to exert pressure and not traction, the spring (pressure spring 23) provided for control lever 4 according to the embodiments shown in FIGS. 1 to 3 is stronger than the spring 73 provided for the control element 7. This can be achieved, for example, by appropriate adjustment of spring 73. When the force ratio is thus selected, the control element 7 is brought from the switching position I into the switching position II by the pressure exerted counter to arrow $P_1$, while the stop bolt 72 is merely lifted out of end 81 of the slotted guide 8 to return the control element 7 from the switching position II into the switching position I (thereby returning the control lever from piecing position to production position), while the return itself is provided by the force of pressure spring 23.

In the embodiment described so far, the control element 7 is capable of movement between two switching positions I and II in the direction of arrow $P_1$ or in the opposite direction, i.e. in the direction of movement of the free end 42 of the control lever 4, where both switching positions are determined. The two stops to determine the production position and the piecing position of control lever 4 are constituted by one single stop element 60 which, in switching position I constitutes the stop for the determination of the production position of control lever 4, and in switching position II of the control element 7 constitutes the stop for the determination of the piecing position of control lever 4.

In the embodiment shown in FIGS. 1 to 3, the control element, in addition to the direction of movement (arrow $P_1$ or opposite direction) of the free end 42 of the control lever 4, also moves transversely in relation to arrow $P_1$, whereby the movements occur transversely in relation to the pivoting axis 40 of the control lever 4, in the embodiment shown in FIGS. 1 to 3. However this is not an absolute condition for the control device.

In the earlier-described embodiment, the U-shaped slotted guide 8 is provided in the cover 5, while the stop bolt 72, interacting with said slotted guide 8, is borne by the control element 7. As FIG. 4 shows, it is also possible to provide an arrangement in which a U-shaped slotted guide 76 is an element of the control element 7, while the stop bolt 72, interacting with the slotted guide 74, is supported by the cover 5. The slotted guide 76, as compared to the slotted guide 8 shown in FIGS. 1 to 3, is made as a mirror image, so that the free ends 760 and 761 extend toward the side which, in relation to the connection segment 762, is furthest from control lever 4.

The function of the device shown in FIG. 4 is identical to that which was already described in the model shown in FIGS. 1 to 3.

Independently of the fact that such a U-shaped slotted guide 76 is provided at the control element 7 or that the U-shaped slotted guide 8 is stationary across from the control element 7, the control of the control lever 4 is prompted by precisely the same control movements.

In the embodiments shown in FIGS. 1 to 4 the control element 7 is provided with two pivoting axes which can be brought into play selectively. One pivoting axis is constituted by the counter-stop 41 of the control lever 4, while the other pivoting axis is constituted by the stop bolt 72 or 52 (FIG. 11) which locates the switching positions I and II of the control element 7 in the embodiments shown. If, however, the control element 7 is to be held in switching position II by maintaining the pressure in a direction counter to arrow $P_1$ upon control element 7 during the time when the spinning element is driven at low speed by the auxiliary drive belt 11, the end 81 or 761 of the slotted guide 8 or 76 can be dispensed with.

According to the embodiments shown, the control element can be moved in the direction of movement of the free end 42 of the control lever 4 as well as transversely to that direction. For this purpose, the control element 7 is mounted so that it can be pivoted. With reference to FIG. 5, an embodiment is described below in which the control element 7 is not mounted in a pivoted manner but is merely capable of linear movement. The control element 7 is provided, in this case, with a sliding block 77 which can be moved back and forth in a straight-line guide 53. The sliding block 77 supports a spring plate 78 extending through cover 5 and provided with a handle 780 at that location. The spring plate 78 is provided with a recess 61 on its underside, as is shown in FIG. 1, whose edge toward the handle 780 constitutes stop 6 (stop element 60). The spring plate 78 has two recesses 781 and 782 into which a stop bolt 54 can be made to catch alternately, to determine the switching positions I and II.

FIG. 5 shows the device with the control lever 4 in the spinning position. If the spinning element is to be braked, and the control lever 4 is to be released by the control element 7 so that control lever 4 can assume its braking position under the influence of pressure spring 23, it is sufficient to exert pressure upon the handle 780 of the spring plate 78 in direction of arrow $P_3$. The counter-stop 41 thus leaves recess 61 in the control element 7 so that control lever 4 is released. In order for the counter-stop 41 to return automatically into recess 61 when the control lever 4 is brought back from the braking position into production position, handle 780 is provided with an inclined surface on its side toward control lever 4, to serve as a ramp for climbing. As it returns from the braking position to the production position, the control lever 4 pushes the handle 780 and also spring plate 78 to the side until counter-stop 41 can catch in recess 61 while climbing on the ramp 783, whereupon the spring plate 78 returns into the shown position.

If the control lever 4 is now to be brought from the switching position, which is the production position of control lever 4, into its other switching position which is the piecing position of control lever 4, pressure on the handle 780 in opposite direction to arrow $P_3$ causes the spring plate 78 to be lifted off stop bolt 54, and spring plate 78 can now be displaced in a direction opposite to the direction of movement indicated by arrow $P_1$ until the stop bolt 54 catches in the recess 782 of the spring plate 78. This movement is assisted by spring 73.

If the control lever 4 is to be brought back into its production position, the handle 780 is again moved in a direction opposite to arrow $P_3$ so that the stop bolt 54 leaves recess 782, causing the control element 7 to return now into the position indicated in FIG. 5 under the effect of the pressure spring 23 through control lever 4, upon spring plate 78.

As can be seen from FIG. 5, the recess 781 in the spring plate 78 can also be eliminated or can be made of such size that it does not serve to locate a switching position of the control element 7, but in that case it is necessary for the edge 530 which limits guide 53 to be made in form of a stop for the slide block 77.

As a comparison between the embodiment shown in FIGS. 1 to 4 with that of FIG. 5 clearly shows, the second control movement of the control lever can be selectively either transverse to the pivoting axis 40 of the control lever 4, or parallel to it.

In the embodiment described through FIGS. 1 to 4, the control element 7 is mounted so as to be capable of pivoting independently of control lever 4. An embodiment of particularly simple design in which the control element 7 is supported on the control lever 4 is described below through FIG. 11. In this embodiment the control element 7 is made in form of a two-arm lever. One arm is made in form of a slotted guide 76 with which a stationary stop bolt 52 or one mounted in a cover 5 (see FIGS. 1 to 5) interacts. The second arm 700 is at an angle with respect to the arm with the slotted guide 76 and extends essentially parallel to the control lever 4. Arm 700, and with it the control element 7, is subjected to the force of a spring 731 which bears upon the control lever 4 in such manner that the slotted guide 76 is pressed against the stop bolt 52 so that it is secured in one of its ends 760 or 761. In principle it is immaterial whether the arm 700 is located on the side towards pivoting axis 40 of control lever 4, in relation to pivoting axis 701, or on the side away from pivoting axis 40. Whether the spring 731 is a pressure spring or a traction spring is also immaterial and only depends on the relative arrangement of arm 700 of the control element 7 with respect to control lever 4. According to FIG. 11 the control lever 4 extends through the pivoting axis 701 beyond the control element 7 and constitutes an extension 43 which is cranked in relation to the remainder of the control lever 4, so that arm 700 of control element 7, and the extension 43, extend essentially parallel to each other and hold a spring 731, made in form of a pressure spring, between them.

Since the control lever 4 is subjected by the pressure spring 23 to move in the direction of arrow $P_1$ (see FIGS. 1 to 3) it does not matter whether or not the ends 760 and 761 of the slotted guide 76 are adapted precisely to the diameter of the stop bolt 52. This also applies to the embodiments shown in FIGS. 1 to 5. It is essential that the lateral edges of the ends 760 and 761 of the slotted guide 76, which interact with the stop bolt 52, are arranged in such a manner, while taking into account the direction in which the control lever 4 is pushed by the pressure spring 23, that they determine precisely the corresponding working position of control lever 4.

Figure 11:
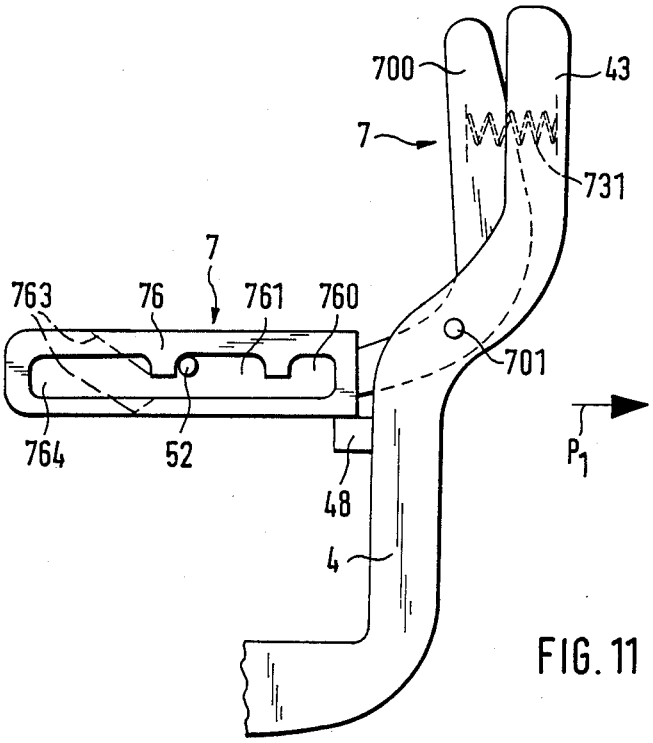
FIG. 11 is a side view of an especially simple design of the control device according to the invention for the control lever.

The slotted guide 76 can be given an open configuration on the side away from control lever 4, in the embodiment according to FIG. 11, so that the stop bolt 52 leaves the slotted guide 76 when the control lever 4 is moved into braking position. To make it possible for the control element 7 with its slotted guide 76 to be again pushed up automatically on the stop bolt 52 as the control lever 4 returns into its production position, the slotted guide 76 is provided in this case with a ramp-like insertion chamfer 763 on one side or two sides, while a stop 48 is provided for the control element 7 to limit its movement.

Since the control lever 4 need not pivot very far in order to reach the braking position, the slotted guide 76 can be made in form of a letter E lying on its side. The connecting segment 762 can be turned toward the pivoting axis of control lever 4 or can be turned away from it, depending on the direction into which the slotted guide 76 is pressed by spring 731. In such an embodiment, in which the U-shaped slotted guide 76 is widened into an E-shape, the third end 764 serves to locate the braking position of control lever 4. Such an E-shaped slotted guide can also be provided for the control element in accordance with FIGS. 1 to 5.

The embodiments shown so far show that the device can be modified in many different ways, through a replacement of individual elements by their equivalents or through different combinations. For example, stop 6 has been an integral part of the control element 7 in the embodiments described so far. However, this is not a necessary condition.

Figure 10:
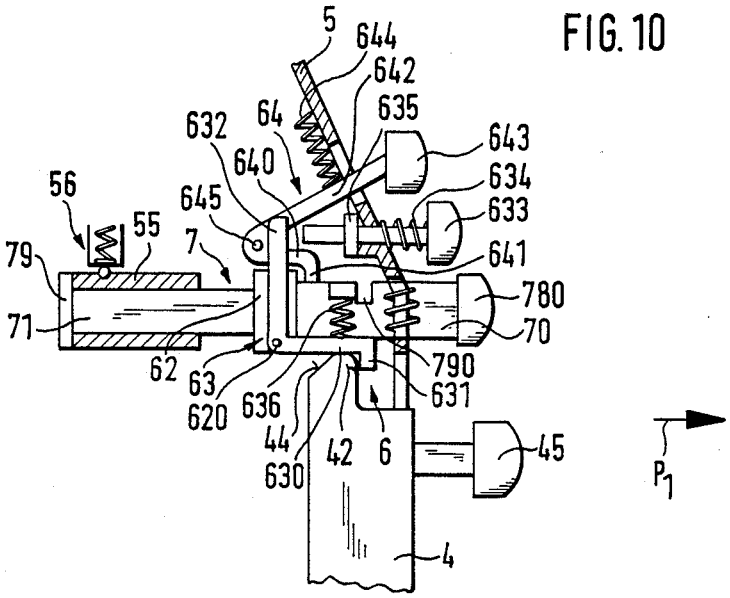
FIG. 10 is a schematic side view of another embodiment of the invention with a control element with linear movement.

FIG. 10 shows an embodiment of the device in which the stop 6 is mounted so as to be capable of movement in relation to the control element 7. The control element 7 is made in form of a slide which is supported in a guide 55 in such manner as to be capable of displacement. The slide-like control element 7 is equipped on its rear end 71 with a stop 79 which interacts with the guide 55. The slide-like control element 7 bears a holding device 62 for a pivoting axis 620 between guide 55 and its service end 70, whereby stop 6, in form of a cranked pivoting lever 63 is supported on said swivelling axis 620. This swivelling lever 63 is provided with a first lever arm 630 extending essentially parallel to the slide-like control element 7 in direction of the service end 70 and which supports on its free end a stop element 631, mounted so as to be capable of movement in relation to the control element 7. This stop element 631, capable of movement relative to the control element 7, interacts with the free end 42 of the control lever 4 which constitutes a counter-stop.

The other lever arm 632 of the pivoting lever 63 extends essentially transversely to the longitudinal extension of the control element 7. It is equipped with an activating knob 633 which is mounted in the cover 5 and is subjected to the force of a pressure spring 634. The stroke path of the activating knob 633 out of the cover 5 is limited by a stop 635 on the shaft extending into cover 5. By pushing knob 633 in the direction of lever arm 632, the activating knob 633 is brought to bear with its shaft end against the lever arm 632 and pivots the pivoting lever 63 in such manner that the stop element 631 finally releases the lever arm 4. Upon release of the activating knob 633, the pivoting lever 63 returns into its basic position since it is subjected to the force of the pressure spring 636 bearing against control element 7.

Another cranked pivoting lever 64 is mounted in a stationary manner or inside cover 5, respectively, by means of a swivelling axis 645. One arm 640 bears a catch 641, the other arm 642 bears an activating knob 643. Arm 642 is subjected to the force of a pressure spring 644 in such manner that the catch 641 is held transversely to the direction of movement of the control element, pressed laterally against the control element 7 which is provided with a recess 790 on its side towards the pivoting lever 64 to receive the catch 641.

For the control lever 4 to be able to go from the production position shown in FIG. 10 into braking position in order to brake the spinning element, the activating knob 633 is depressed so that the stop element 631 may release the free end 42 of the control lever 4. The control lever 4 can thus reach its braking position under the influence of pressure spring 23 and can stop the spinning element. A catching device 56 is provided in the guide 55 to hold the control element 7 in its place even after release of the control lever 4.

The free end 42 of the control lever 4 is provided with a climbing ramp 44 so that said climbing ramp 44 may lift up the stop element 631 in opposition to the effect of the pressure spring 636 as the control lever 4 is pivoted back from its braking position into its production position, until said stop element 631 finally catches once more behind the free end 42 of the control lever 4. To push back the control lever 4 from the braking position into the production position, an appropriate activating knob 45 is provided on the control lever 4.

The above-mentioned catch 56 is made so as to ensure that the control element 7 is not displaced but remains in its switching position during this return of the control lever 4 from braking position into production position.

If, now, after the desired run-up of the spinning element, the shaft 1 is to be connected with the auxiliary drive belt 11, this is achieved by shifting the control element 7 counter to the direction of arrow $P_1$. Catch 56 then releases the slide-like control element 7. Finally, under the influence of compression pressure spring 644, the catch 641 catches in the recess 790 of the control element 7 and fixes it, and with it also control lever 4, which is slaved by control element 7 through stop element 631, in the switching position.

If the spinning element is to be driven again by the main drive belt 10, activating knob 643 is moved so that the catch 641 releases the control element 7 which returns into the position shown in FIG. 10, in which stop 79, under the influence of the pressure spring 23, climbs on the guide 55 and locates the production position of the control lever 4.

As FIG. 10 shows, all the elements to be controlled are controlled by means of parallel adjusting levers and forces. These forces can be provided here manually or by means of adjusting means 130, 131 . . . of an automatic device, e.g. a conventional piecing device 13 (see FIG. 12), which travels alongside an open-end spinning machine with a plurality of identical spinning stations. Thus, drive surfaces are provided for the control lever 4 as well as for control element 7, for the stop element 631 capable of relative movement with respect to control lever 4, as well as for the catch 641, constituting a stop for the control element 7. The drive surfaces are constituted by the control lever 4 or by an activating knob 45, by the handle 780 of control element 7, by the control knob 633 or by the control knob 643.

Figure 12:
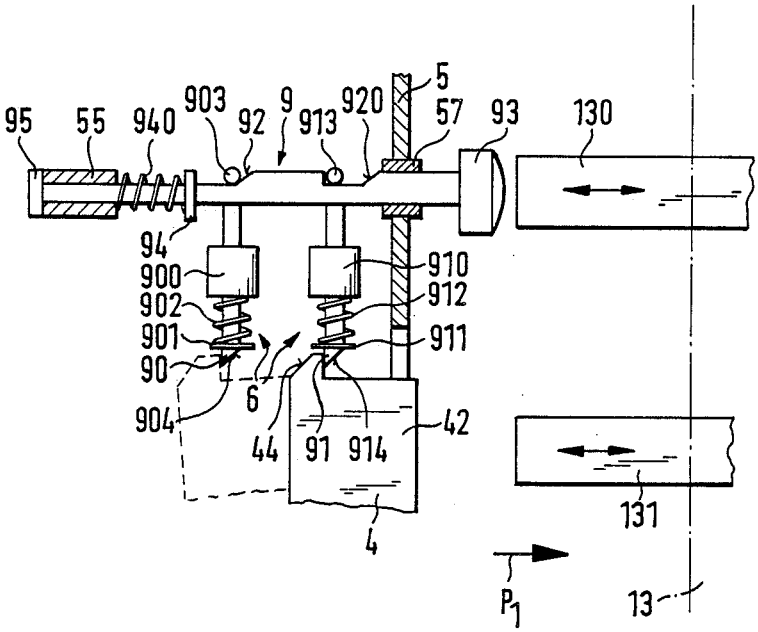
FIG. 12 is a schematic side-view of yet another embodiment of the object of the invention in which the stops for the control lever are mounted independently of the control element but are nevertheless controlled by it.

The pivoting lever 64, as well as the recess 790 in the control element 7, can be omitted if the control element is to be controlled by the adjusting means 130, 131 . . . of the travelling piecing device 13, as is indicated in the embodiment shown in FIG. 12. These adjusting means 130, 131 . . . have a determined lifting path which brings the control element 7, and with it also the control lever 4 into an end position that corresponds to the piecing position of the control lever 40.

Although it was assumed in the described embodiment that the control element 7 is located in cover 5, this is not a requirement. The control can be exercised entirely independently of cover 5. For this reason no cover is shown in FIG. 11.

Figure 6:
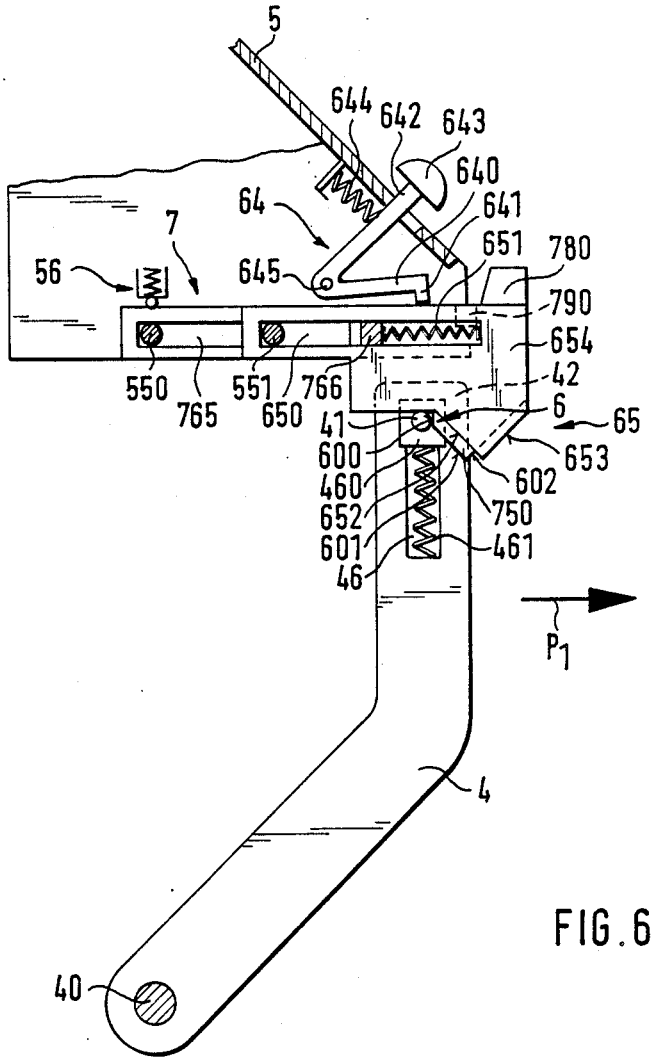
FIGS. 6 to 8 show another embodiment of the invention in schematic side-views, with a control element having a linear movement in its production, braking and piecing positions.
Figure 9:
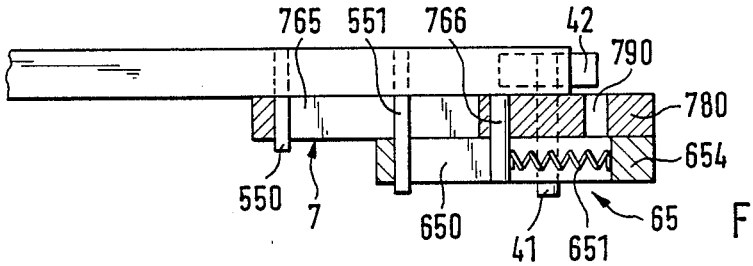
FIG. 9 shows the device of FIGS. 6 to 8 in production position, in top view and in partial section.
Figure 8:
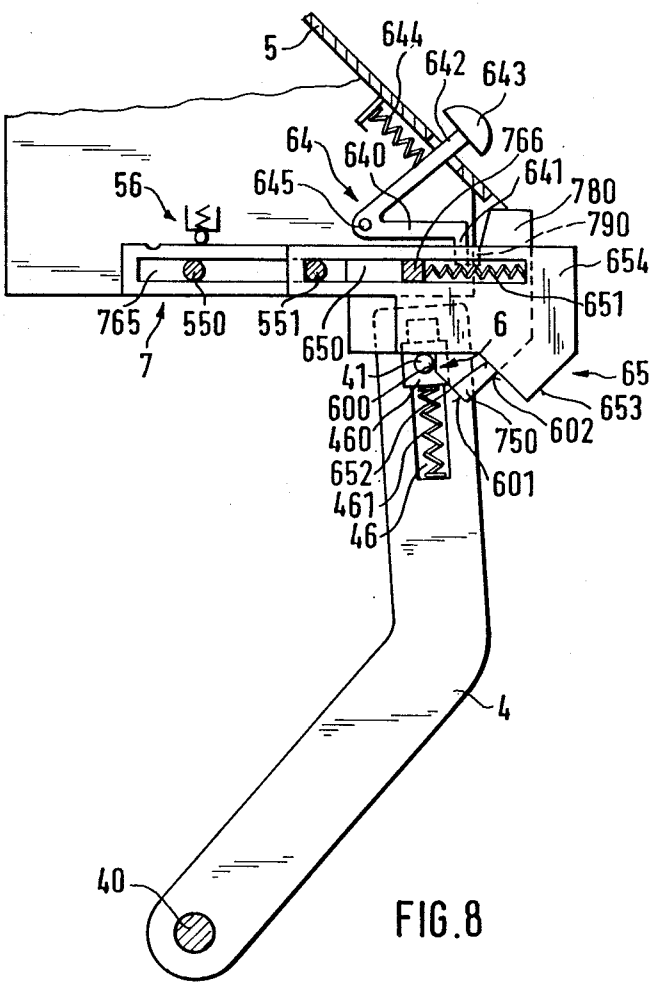
Figure 7:
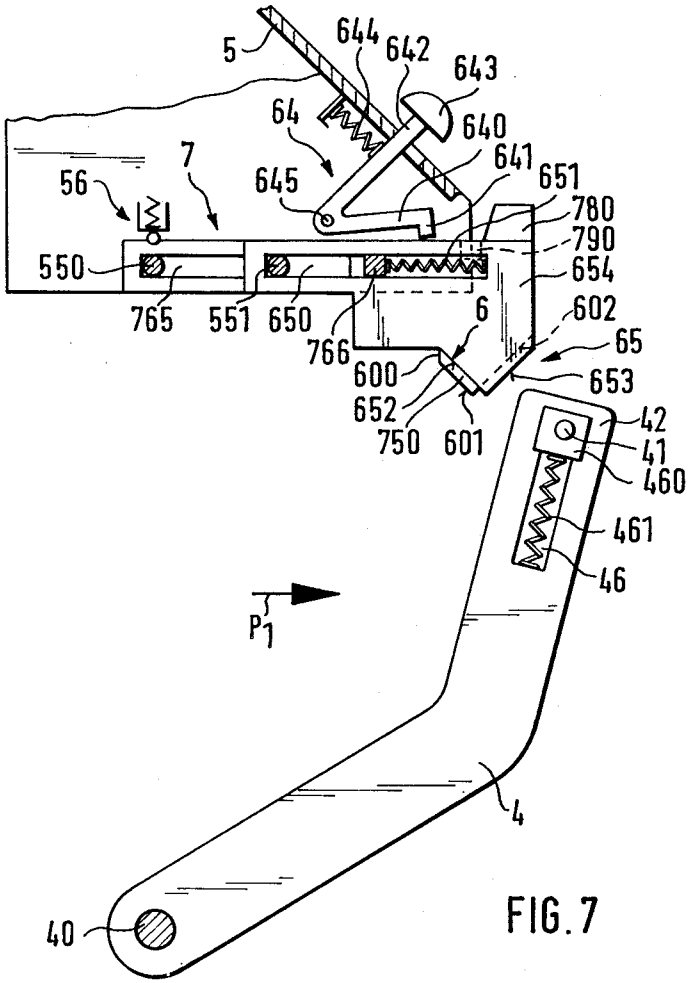

A further embodiment of the device is shown in FIGS. 6 to 9. FIG. 6 shows the device in the production position of control lever 4, FIG. 7 shows the device in the braking position of the control lever 4, and FIG. 8 shows the device in piecing position of control lever 4. The control element 7 is made in form of a slide in this embodiment, and is provided with an oblong opening 765 into which two guide bolts 550 and 551 engage. The guide bolts 550 and 551 are supported by the cover 5 (in a manner not shown) or are supported in a different manner, stationary in relation to the control element 7. The oblong opening 765 is sized so that its two stop positions determine the two switching positions of the control element 7, these switching positions correspond to the production position or the piecing position of the control lever 4. The switching position corresponding to the production position of the control lever 4 is set with the help of a catching device 56. For the other switching position, corresponding to the piecing position of the control lever 4, the slide-like control element is provided with a recess 790 (see FIG. 9), with which the catch 641 of a pivoting lever 64 interacts.

On its side away from the pivoting lever 64, the control element 7 is provided with a projection 750 (See FIG. 7) with an edge that is oriented perpendicularly to the direction of movement indicated by arrow $P_1$ and that is made as a stop element 600 for a counter-element 41 of the control lever 4. A climbing ramp 601 follows the edge constituting the stop element 600, climbing ramp 601 is inclined on the one hand in direction of the pivoting axis 40 of the control element 4 (i.e. counter to the direction indicated by an arrow $P_2$ in FIG. 2) and is inclined on the other hand in direction of arrow $P_1$. Climbing ramp 601 is designed to enable pivoting of the control lever 4 from its production position into its braking position, as shall be explained in further detail hereinbelow. Climbing ramp 601 is followed by another climbing ramp 602 which is oriented so that it enables pivoting of the control lever 4 from its braking position into its production position.

Since the control element 7 is merely capable of sliding but cannot be moved transversely to its sliding direction, the counter stop 41, according to the embodiment shown in FIGS. 6 to 9, is resiliently mounted so as to be able to yield laterally in the longitudinal direction of the control lever 4 as it climbs on the climbing ramp 601 or 602. For this purpose, the control lever 4 is provided with a slotted guide 46 in which the counter-stop 41 is mounted by means of a sliding block 460. This sliding block 460 is subjected to the elastic force of a pressure spring 461 in direction of the free end 42 of the control lever 4. Thus, a second stop element (counter-stop 41), located on the control lever 4 is provided for the stop element 600 and integrated into the control element 7. The stop element is capable of movement transversely to the direction of movement ($P_1$) of the free end 42 of the control lever 4. In order to obtain this movement, transversely to the direction of movement of the free end 42 of the control lever 4, control element 7 is provided with a drive element 65. In principle, this drive element 65 can be stationary, or it can be located directly on the cover 5, respectively. The drive element 65 can be moved in relation to the control element 7 and, in the embodiment shown in FIGS. 6–9, it is mounted on the control element 7 so as to be capable of movement in relation to the control element 7. For this purpose the drive element 65 is also provided with an oblong opening 650 into which the guide bolt 551 on the one hand, and a spring receptacle 766 supported by the control element 7 on the other hand, extend. A pressure spring 651 is provided between the end of the oblong opening 650 away from the guide bolt 551 and the spring receptacle 766.

As with the control element 7, the drive element 65 is provided on its side toward the control lever 4 with two climbing ramps 652 and 653 for the two directions of movement of the control lever 4. The climbing ramp 652 is arranged so that it does not normally come into contact with the counter-stop 41, but is held at a distance from the latter under the influence of the pressure spring 651, while the position of climbing ramp 652 in relation to climbing ramp 601 is determined by the guide bolt 551 by which the drive element 65 presses with the end of its longitudinal opening 650.

If the control lever 4 is to be brought from its drive position shown in FIG. 6 into its braking position, pressure is exerted in a direction opposite to that of arrow $P_1$ upon the end in form of activating element 654, away from the guide bolt 551. At the same time the climbing ramp 652 is shifted in the direction of the counter-stop 41 and said counter-stop 41 is thus removed from contact with the control element 7, contrary to the effect of pressure spring 461.

The counter-stop 41 is, in that case, shifted parallel to stop element 600, and thus arrives on the climbing ramp 601. Due to the pressure exerted by pressure spring 23 upon control lever 4, the latter is now pivoted in the direction of arrow $P_1$ and leaves the effective range of control element 7 and drive element 65.

If the control lever 4 is now to be returned into production position, this is made possible by pressure exerted upon the control lever 4 in opposite direction of arrow $P_1$. Counter-stop 41 of control lever 4 then climbs up on climbing ramps 653 and 602, then slides along climbing ramps 653 and/or 601 and finally arrives again behind the stop element 600 which retains control lever 4 in its production position. The catch 56 is arranged so that the control element 7 does not leave its shown position when the control lever 4 is brought from braking position into production position.

If the control lever 4 is now to be brought into the piecing position immediately or after a certain time, pressure is exerted upon handle 780 of the control lever 7 in a direction opposite to that of arrow $P_1$. Stop element 600, which is an integral component of control element 7, then slaves the control lever 4 as it moves opposite to arrow $P_1$ over the counter-stop 41. When control element 7 reaches its switching position corresponding to the piecing position of the control lever 4, the catch 641 of pivoting lever 64 catches in the recess 790 of the control element 7 and fixes the control element 7 and the control lever 4 in that position (FIG. 8).

In order to return control lever 4 to the production position, catch 641 is lifted out of recess 790 by actuating the activating knob 643. As a result of the action of spring 23, control lever 4 is returned to the position shown in FIG. 6, the position being located by the end of oblong opening 765 running against the guide bolt 550. In this position also, the catching device 56 again engages in the slide-like control element 7, and additionally secures the latter in this position.

It is not required for stop 6 to be an integral component of the control element 7 or for it to be mounted on the control element 7.

FIG. 12 shows another embodiment of the device in which a stop 90 or 91 is provided for the production position of the control lever 4 as well as for its piecing position. Each stop is bearingly supported in an appropriate manner on the cover 5 by means of a bearing 900 or 910. Each stop is equipped with respect to bearing 900 or 910 with a spring supporting disk 901 or 911 on its side towards the free end 42 of the control lever 4. Between these spring supporting disk 901 or 911 and the bearing 900 or 910 is a pressure spring 902 or 912 which presses stop 90 or 91 in direction of the control lever 4. Stop 90 or 91 extends on the side away from the control lever 4 beyond the bearing 900 or 910 and is provided on its free end, transversely to its direction of movement, with a bolt 903 or 913. The two bolts 903 and 913 bear against a control element 9 which is mounted in guides 55 and 57 in such manner as to be capable of being shifted transversely to the lifting direction of the stops 90 and 91. On its side away from bearings 900 and 910, the control element 9 is equipped with two climbing cams 92 and 920, with climbing cam 92 being capable of interacting with the bolt 903 of stop 90 and climbing cam 920 being capable of interacting with bolt 913 of stop 91.

The control element 9 extends to the outside of cover 5 and is provided with an activating knob 93 at that location. A spring supporting disk 94 is provided between guide 55 and climbing cam 92. A pressure spring 940 which constantly pushes the activating knob 93 out of cover 5 is located between this spring supporting disk 94 and the guide 55. On its end away from the activating knob 93, the control element 9 is equipped with a stop 95 which can be brought to bear against the guide 55.

The climbing cams 92 and 920 are at different distances from their assigned bolts 903 or 913 when the control element 9 is in the position shown. If a pressure counter to the effect of pressure spring 940 is exerted upon the activating knob 93, bolt 903 of stop 90 first comes within range of the climbing cam 92 so that stop 90 is lifted. As the movement of the control element 9 continues, the climbing cam 920 also comes within range of bolt 913 of stop 91, so that this stop 91 is now also lifted.

With the help of the last-described device the control lever 4 is controlled and the spinning element is controlled as follows:

In the shown production position, lever 4 is held in production position by stop 91. When the control element 9 is pushed completely to the left in FIG. 12 by pressure exerted upon the activating knob 93, the two stops 90 and 91 are lifted. Stop 91 thus releases the control lever which can thereby be pivoted into its braking position. The control element 9 is then again released and returns into the position shown in FIG. 12 under the effect of pressure spring 940.

If the control lever is to be returned into its production position it s pivoted, in the manner described earlier, in the direction of cover 5, where the control lever 4 climbs with its end 42 which is provided with a climbing ramp 44 upon a corresponding bevel 914 of stop 91 and shifts it counter to the effect of pressure spring 912 until control lever 4 has reached its production position and stop 91 catches again behind end 42 of the control lever 4.

If the control lever 4 now continues to be pivoted counter to the direction of arrow $P_1$, the climbing ramp 44 of control lever 4, by climbing upon bevel 904 of stop 90, causes stop 90 to be at first displaced until the control lever has reached its piecing position and secured as stop 90 again catches in this position.

If the control lever 4 is to be brought back into its production position after the piecing operation, the control element 9 is displaced by pressure exerted upon the activating knob 93 until the climbing cam 92 lifts stop 90 over bolt 903 and releases the control lever 4. Bolt 913, on the other hand, does not reach the lifting area of the climbing cam 920. The control lever 4 released by stop 90 can thus be pivoted in the direction of arrow $P_1$ only so far as to return into its production position, since it reaches stop 91 at that point with its end 42, which itself constitutes a stop.

The two stops 90 and 91 are thus subjected to an elastic force in direction of control lever 4 and are subject to the control of climbing rams 92 and 920, which spring into action with different switching paths of the control lever 9 in such manner that the stop determining the piecing position of control lever 4 comes into operation first, while stop 91 comes into operation to determine the production position of the control lever 4 only after a longer switching path has been covered.

The last-described device of FIG. 12, contrary to the embodiments described earlier, requires that two-step lifting paths be provided for the movement of control lever 4 and for the movement of control element 9.

The control of control element 9 or control lever 4 can be carried out with the help of the adjusting means 130, 131 which are provided on a piecing device 13 capable of travelling alongside the open-end spinning machine.

Although the above description first of all explains how the spinning element is driven with the main drive belt 10 before it is switched over to piecing speed, this does not mean that the spinning element must first be brought to production speed before it is possible to switch over to piecing speed. Control timing is much rather left to the decision of the operator or depends upon the manner in which the piecing device 13 is programmed. This control timing can also be determined so that the piecing lever 4 can be brought from braking position directly into piecing position if necessary. It is equally possible for the control lever 4 to remain for a shorter or longer period of time in the production position before being moved into the piecing position. If desired, the spinning element can also be brought directly to production speed if it is possible to carry out piecing at that speed.

What is claimed is:

1. A control device for controlling the operation of an open-end spinning element, comprising:

(a) a first drive means for driving said openend spinning element at a production rate of speed;

(b) a second drive means for driving said open-end spinning element at a piecing rate of speed;

(c) braking means for applying a braking force to said open-end spinning element for stopping its rotation;

(d) a pivoted control lever, one end of which is operatively connected to selectively connect said first or second drive means to drive said open-end spinning element or to apply said braking means to said element for stopping it, and the other end of which is movable between a production position whereby said open-end spinning element is connected to said first drive means, a piecing position whereby said open-end spinning element is connected to said second drive means, and a stopping position wherein said braking means is applied to stop the rotation of said open-end spinning element;

(e) a common control element adapted to selectively engage and hold said other end of said control lever in the production and piecing positions, said control element being capable of recipricatory motion between said production and said piecing positions and being movable to apply said braking means to said open-end spinning element; and (f) means to hold said control element in either the production or piecing positions, whereby said open-end spinning element is selectively connected to said first or second drive means by said pivoted control lever.

2. A control device as set forth in claim 1, wherein a stop element is disposed on said control element for determining at least one of the positions of said control lever.

3. A control device as set forth in claim 2, wherein said stop element is an integral part of said control element.

4. A control device as set forth in claim 3, wherein said control element is capable of being moved transversely to the direction of its recipratory motion between said production and piecing positions.

5. A control device as set forth in claim 4, wherein said control element is pivotally supported for said transverse movement.

6. A control device as set forth in claim 4, wherein said control element is capable of being moved transversely to the pivot of said control lever.

7. A control device as set forth in claim 6, wherein an essentially U-shaped slotted guide, the ends of which extend transversely to the direction of the recipratory movement of said control element, together with a stop bolt engaged in said slotted guide, determine two of the positions of said control element.

8. A control device as set forth in claim 7, wherein said U-shaped slotted guide is disposed on said control element.

9. A control device as set forth in claim 8, wherein said control element is supported pivotally on said control lever.

10. A control device as set forth in claim 9, wherein said control element is made in the form of a two-arm lever, the first arm of which is provided with said slotted guide and the second arm of which extends substantially parallel to said control lever and is subjected to the force exerted upon said control lever by a spring in such a manner that said stop bolt in said first arm remains in one of the ends of said slotted guide.

11. A control device as set forth in claim 10, wherein said control lever is provided with an extension which extends beyond the support point of said control element, whereby said second arm of said two arm lever extends substantially parallel to said extension.

12. A control device as set forth in claim 7, wherein said slotted guide is E-shaped.

13. A control device as set forth in claim 6, wherein said control element is provided with two pivoting axes either of which can be brought into operation selectively, whereby one of said pivoting axes is provided for the stop element and the other of said pivoting axes is provided by a stop which determines at least one of said positions.

14. A control device as set forth in claim 6, wherein said control element is provided with a stop which limits its movement in the direction of said control lever.

15. A control device as set forth in claim 3, wherein a stop element is provided for a second stop element integrated into said control element, said second stop element being located on the free end of said control lever and being capable of being moved transversely to the direction of movement of said free end of said control lever, whereby a drive element capable of being moved in relation to said control element is provided for said stop element.

16. A control device as set forth in claim 15, wherein said drive element is mounted on said control element and is capable of being moved relative to said control element.

17. A control device as set forth in claim 16, wherein said drive element can be moved in the direction of movement of said control element and is provided with a climbing ramp to disengage the stop element movably mounted on said free end of said control lever from the stop element which is integrated with said control element.

18. A control device as set forth in claim 2, wherein said stop element is movably mounted relative to said control element.

19. A control device as set forth in claim 18, wherein said movably mounted stop element is part of a pivoting lever.

20. A control device as set forth in claim 2, wherein said control element is subjected to the force of a spring opposed to the force exerted on said control lever.

21. A control device as set forth in claim 20, wherein said spring is adjustable.

22. A control device as set forth in claim 21, wherein said spring is provided with a continuous adjusting device.

23. A control device as set forth in claim 20, wherein the force on said control lever is stronger than the force of said spring on said control element.

24. A control device as set forth in claim 1, wherein said control element is provided with a stop which is capable of being moved transversely of the direction of movement of said control element.

25. A control device as set forth in claim 24, wherein each of the control lever, the control element, the stop which is movable relative to said control element, the drive element for the stop element movably mounted on the free end of said control lever and the stop element movable relative to said control element is provided with a drive surface which can be subjected to the force of adjusting means capable of linear movement.

26. A control device as set forth in claim 1, wherein said control element is provided with a guide which limits its transverse movements relative to the free end of said control lever as said control element reciprocates.

27. A control device as set forth in claim 1, wherein said open-end spinning element is provided with a cover and said control element is mounted within said cover.

28. A control device as set forth in claim 1, wherein the position of said control lever and said control element can be controlled by a traveling piecing device which travels alongside a plurality of spinning stations each of which contains an open-end spinning element.

29. A control device as set forth in claim 28, wherein the piecing position of said control element can be determined by adjusting means disposed on the traveling piecing device.

30. A control device as set forth in claim 1, wherein a plurality of stops are pressed resiliently in the direction of said control lever and bear their ends away from said control lever and upon climbing ramps of said control element, whereby one of said climbing ramps is assigned to stop the control lever in the production position and the other of which stops the control lever in the piecing position after covering a longer path.

* * * * *